US006921021B2

(12) United States Patent
Nally et al.

(10) Patent No.: US 6,921,021 B2
(45) Date of Patent: Jul. 26, 2005

(54) SPRAY PATTERN CONTROL WITH NON-ANGLED ORIFICES FORMED ON A DIMPLED FUEL INJECTION METERING DISC HAVING A SAC VOLUME REDUCER

(75) Inventors: John F. Nally, Williamsburg, VA (US); William A. Peterson, Jr., Smithfield, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/753,377

(22) Filed: Jan. 9, 2004

(65) Prior Publication Data

US 2004/0217213 A1 Nov. 4, 2004

Related U.S. Application Data

(60) Provisional application No. 60/439,059, filed on Jan. 9, 2003, provisional application No. 60/438,952, filed on Jan. 9, 2003, and provisional application No. 60/439,094, filed on Jan. 9, 2003.

(51) Int. Cl.[7] ..... F02D 1/06

(52) U.S. Cl. ..... 239/5; 239/533.12; 239/533.2; 239/585.1; 239/596; 239/598; 239/900

(58) Field of Search ..... 239/596, 533.12, 239/533.14, 598, 601, 533.2, 585.1, 585.4, 585.5, 900, 5; 251/129.21, 129.17, 129.19

(56) References Cited

U.S. PATENT DOCUMENTS

| | | | | |
|---|---|---|---|---|
| 335,334 | A | 2/1886 | Brady | |
| 600,687 | A | 3/1898 | Flemming | |
| 2,737,831 | A | 3/1956 | Webb | |
| 2,846,902 | A | 8/1958 | Cowley | |
| 4,057,190 | A | 11/1977 | Kiwior et al. | |
| 4,072,039 | A | 2/1978 | Nakanishi | |
| 4,101,074 | A | 7/1978 | Kiwior | |
| 4,532,906 | A | 8/1985 | Höppel | |
| 4,621,772 | A * | 11/1986 | Blythe et al. | 239/585.4 |
| 4,923,169 | A | 5/1990 | Grieb et al. | |
| 4,925,111 | A | 5/1990 | Foertsch et al. | |
| 4,970,926 | A | 11/1990 | Ghajar et al. | |
| 5,002,231 | A | 3/1991 | Reiter et al. | |
| 5,038,738 | A | 8/1991 | Hafner et al. | |
| 5,201,806 | A | 4/1993 | Wood | |
| 5,244,154 | A | 9/1993 | Bucholz et al. | |
| 5,335,864 | A | 8/1994 | Romann et al. | |
| 5,344,081 | A | 9/1994 | Wakeman | |

(Continued)

FOREIGN PATENT DOCUMENTS

| | | | |
|---|---|---|---|
| DE | 10034293 | 1/2001 | F02M/61/18 |
| EP | 1 092 865 A | 4/2001 | |
| EP | 1 154 151 | 11/2001 | |
| EP | 1154151 | 11/2001 | F02M/61/18 |
| JP | 52-32192 | 3/1977 | |
| JP | 59-223121 | 12/1984 | |
| JP | 60-137529 | 7/1985 | |
| JP | 10-122096 | 12/1998 | |
| JP | 2000-097129 | 9/2000 | |
| WO | WO 00/52328 | 9/2000 | |
| WO | WO 0244551 | 6/2002 | F02M/61/18 |

OTHER PUBLICATIONS

PCT International Search Report (PCT/US 2004/000594) Mailed Jul. 2, 2004.

*Primary Examiner*—Dinh Q. Nguyen

(57) ABSTRACT

A fuel injector that includes a housing, a seat, a metering disc and a closure member. The metering orifices can be located on a first virtual circle greater than a second virtual circle as defined by a projection of a sealing surface converging at a virtual apex projected on the metering disc. The metering disc can be dimpled to increase the spray angle. Various parameters can be utilized to achieve a desired cone size and spray angle. A method of controlling spray targeting of a fuel injector is also described.

20 Claims, 2 Drawing Sheets

U.S. PATENT DOCUMENTS 5,365,819 A 11/1994 Maida et al.
5,449,114 A 9/1995 Wells et al.
5,484,108 A * 1/1996 Nally ..... 239/553.3
5,489,065 A 2/1996 Nally
5,516,047 A 5/1996 Kubach et al.
5,548,065 A 8/1996 Lemischka
5,553,397 A 9/1996 Schwitzky et al.
5,636,796 A 6/1997 Oguma
5,697,154 A 12/1997 Ogihara
5,730,368 A 3/1998 Flik et al.
5,746,376 A 5/1998 Romann et al.
5,766,441 A 6/1998 Arndt et al.
5,772,124 A 6/1998 Tamaki et al.
5,785,254 A 7/1998 Zimmermann et al.
5,816,093 A 10/1998 Takeuchi et al.
5,862,991 A 1/1999 Willke et al.
5,931,391 A 8/1999 Tani et al.
6,009,787 A 1/2000 Hänggi
6,039,271 A 3/2000 Reiter
6,070,812 A 6/2000 Tani et al.
6,089,476 A 7/2000 Sugimoto et al.
6,102,299 A 8/2000 Pace et al.
6,131,826 A 10/2000 Teiwes
6,170,763 B1 1/2001 Fuchs et al.
6,394,367 B2 5/2002 Munezane et al.
6,405,946 B1 6/2002 Harata et al.
6,616,071 B2 * 9/2003 Kitamura et al. ..... 239/533.12
6,742,727 B1 * 6/2004 Peterson, Jr. ..... 239/533.3
2002/0063175 A1 5/2002 Kitamura et al.

* cited by examiner

SPRAY PATTERN CONTROL WITH NON-ANGLED ORIFICES FORMED ON A DIMPLED FUEL INJECTION METERING DISC HAVING A SAC VOLUME REDUCER

PRIORITY

This application claims the benefits of the following U.S. provisional patent applications:

Ser. No. 60/439,059 filed on Jan. 09, 2003, entitled "Spray Pattern Control With Non-Angled Orifices Formed On A Generally Planar Metering Disc And Reoriented On Subsequently Dimpled Fuel Injection Metering Disc,"

Ser. No. 60/438,952, filed on Jan. 09, 2003 entitled "Spray Pattern Control With Non-Angled Orifices Formed On A Dimpled Fuel Injection Metering Disc Having A Sac Volume Reducer,"

Ser. No. 60/439,094 filed on Jan. 09, 2003, entitled, "Spray Pattern Control With Non-Angled Orifices Formed On Dimpled Fuel Injection Metering Disc Having A Sac Volume Reducer," which provisional patent applications are herein incorporated by reference in their entirety in this application.

BACKGROUND OF THE INVENTION

Most modern automotive fuel systems utilize fuel injectors to provide precise metering of fuel for introduction into each combustion chamber. Additionally, the fuel injector atomizes the fuel during injection, breaking the fuel into a large number of very small particles, increasing the surface area of the fuel being injected, and allowing the oxidizer, typically ambient air, to more thoroughly mix with the fuel prior to combustion. The metering and atomization of the fuel reduces combustion emissions and increases the fuel efficiency of the engine. Thus, as a general rule, the greater the precision in metering and targeting of the fuel and the greater the atomization of the fuel, the lower the emissions with greater fuel efficiency.

An electromagnetic fuel injector typically utilizes a solenoid assembly to supply an actuating force to a fuel metering assembly. Typically, the fuel metering assembly is a plunger-style needle valve which reciprocates between a closed position, where the needle is seated in a seat to prevent fuel from escaping through a metering orifice into the combustion chamber, and an open position, where the needle is lifted from the seat, allowing fuel to discharge through the metering orifice for introduction into the combustion chamber.

The fuel injector is typically mounted upstream of the intake valve in the intake manifold or proximate a cylinder head. As the intake valve opens on an intake port of the cylinder, fuel is sprayed towards the intake port. In one situation, it may be desirable to target the fuel spray at the intake valve head or stem while in another situation, it may be desirable to target the fuel spray at the intake port instead of at the intake valve. In both situations, the targeting of the fuel spray can be affected by the spray or cone pattern. Where the cone pattern has a large divergent cone shape, the fuel sprayed may impact on a surface of the intake port rather than towards its intended target. Conversely, where the cone pattern has a narrow divergence, the fuel may not atomize and may even recombine into a liquid stream. In either case, incomplete combustion may result, leading to an increase in undesirable exhaust emissions.

Complicating the requirements for targeting and spray pattern is cylinder head configuration, intake geometry and intake port specific to each engine's design. As a result, a fuel injector designed for a specified cone pattern and targeting of the fuel spray may work extremely well in one type of engine configuration but may present emissions and driveability issues upon installation in a different type of engine configuration. Additionally, as more and more vehicles are produced using various configurations of engines (for example: inline-4, inline-6, V-6, V-8, V-12, W-8 etc.,), emission standards have become stricter, leading to tighter metering, spray targeting and spray or cone pattern requirements of the fuel injector for each engine configuration.

It would be beneficial to develop a fuel injector in which increased atomization and precise targeting can be changed so as to meet a particular fuel targeting and cone pattern from one type of engine configuration to another type.

It would also be beneficial to develop a fuel injector in which non-angled metering orifices can be used in controlling atomization, spray targeting and spray distribution of fuel.

SUMMARY OF THE INVENTION

The present invention provides fuel targeting and fuel spray distribution with non-angled metering orifices. In a preferred embodiment, a fuel injector is provided. The fuel injector comprises a housing, a seat, a metering disc and a closure member. The housing has an inlet, an outlet and a longitudinal axis extending therethrough. The seat is disposed proximate the outlet. The seat includes a sealing surface, an orifice, and a first channel surface. The first channel surface extends generally orthogonal to the longitudinal axis. The closure member is reciprocally located within the housing along the longitudinal axis between a first position wherein the closure member is displaced from the seat, allowing fuel flow past the closure member, and a second position wherein the closure member is biased against the seat, precluding fuel flow past the closure member. The metering disc has a plurality of metering orifices extending through the metering disc along the longitudinal axis. The metering orifices are located about the longitudinal axis on a first virtual circle greater than a second virtual circle defined by a projection of the sealing surface converging at a virtual apex disposed on the metering disc. The metering disc includes a second channel surface confronting the first channel surface. The second channel surface has at least a first surface portion generally oblique to the longitudinal axis and at least a second surface portion forming a curved surface with respect to the longitudinal axis. The controlled velocity channel is formed between the first and second channel surfaces. The controlled velocity channel has a first portion changing in cross-sectional area as the channel extends outwardly along the longitudinal axis to a location cincturing the plurality of metering orifices such that a fuel flow path exiting through each of the plurality of metering orifices forms a flow path oblique to the longitudinal axis.

In yet another embodiment, a method of controlling a spray angle of fuel flow through at least one metering orifice of a fuel injector is provided. The fuel injector has an inlet and an outlet and a passage extending along a longitudinal axis therethrough. The outlet has a seat and a metering disc. The seat has a seat orifice and a first channel surface extending generally orthogonal to the longitudinal axis. The metering disc includes a second channel surface confronting the first channel surface. The metering disc has a plurality of metering orifices extending therethrough along the longitudinal axis and located about the longitudinal axis. The method is achieved by inducing the fuel flow to flow radially outward along the longitudinal axis between the first and second channel surfaces, the first channel surface extending generally orthogonal to the longitudinal axis; deforming a portion of the second channel surface, at a dimpling angle relative to the longitudinal axis, on which the plurality of metering orifices are located so that a flow path of the fuel flow through each of the metering orifices is oblique with respect to the longitudinal axis as a function of the radial velocity and the dimpling angle; and reducing a sac volume formed between the first channel surface and the second channel surface.

BRIEF DESCRIPTIONS OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
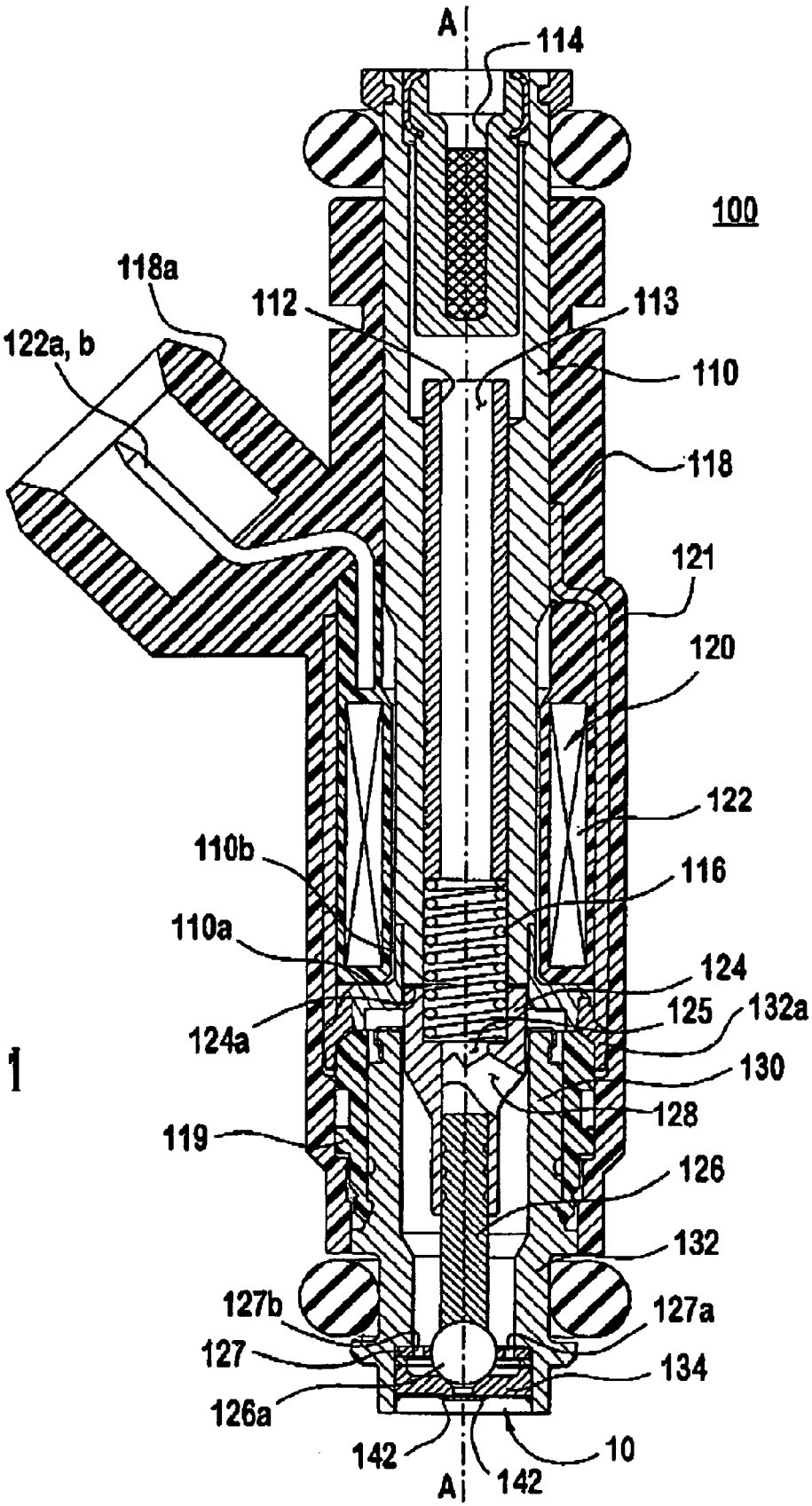
FIG. 1 illustrates a preferred embodiment of the fuel injector.
Figure 2:
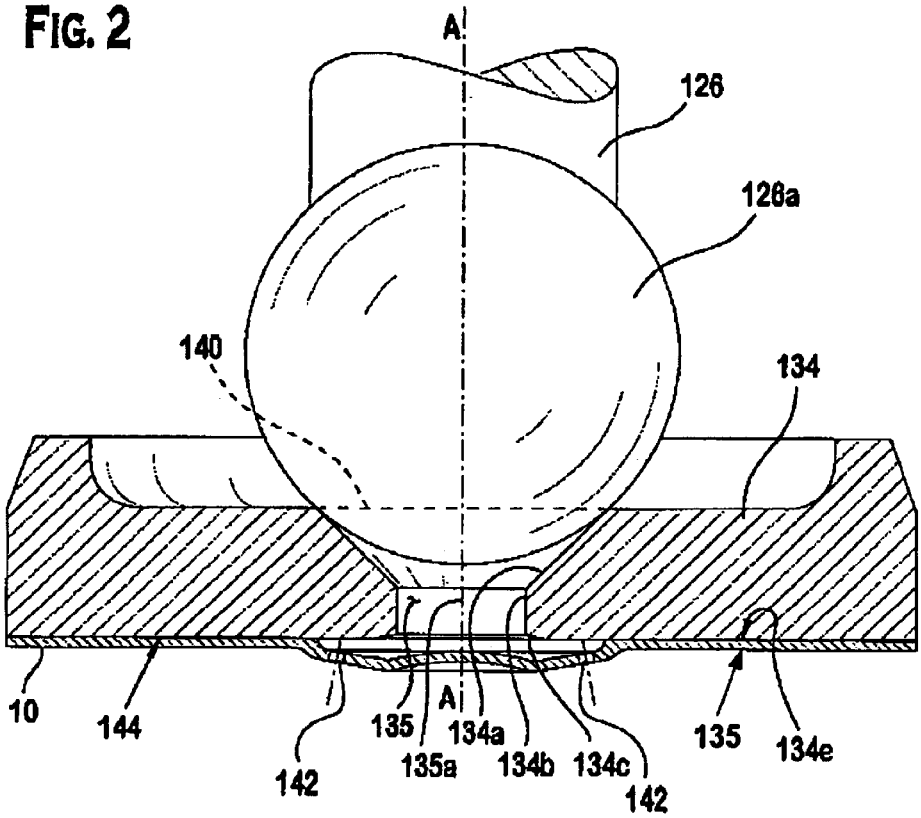
FIG. 2 illustrates a close-up cross-sectional view of an outlet end of the fuel injector of FIG. 1.
Figure 3:
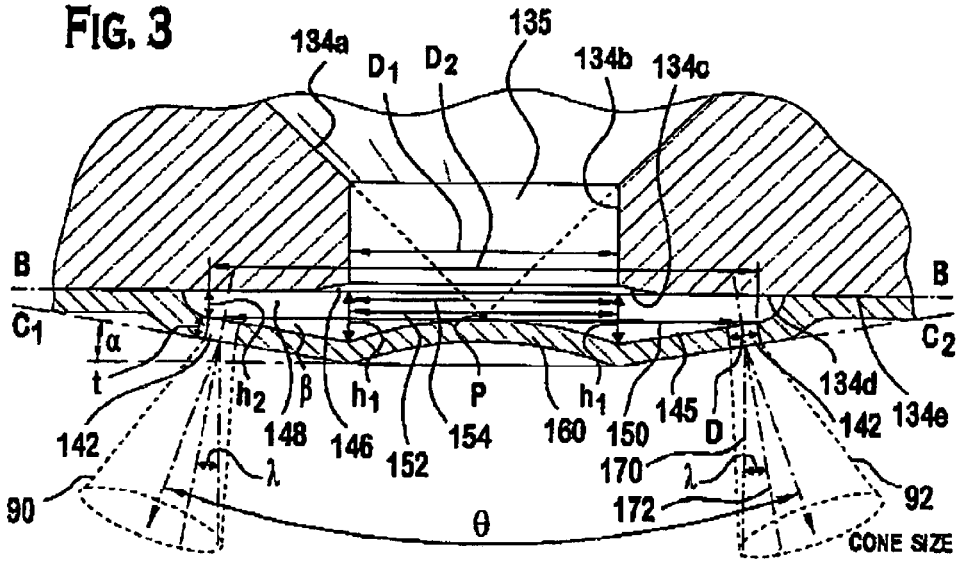
FIG. 3 illustrates a close-up cross-sectional view of an outlet end of the fuel injector of FIG. 1 according to yet another preferred embodiment.

FIGS. 1–3 illustrate the preferred embodiments. In particular, a fuel injector 100 having a preferred embodiment of the metering disc 10 is illustrated in FIG. 1. The fuel injector 100 includes: a fuel inlet tube 110, an adjustment tube 112, a filter assembly 114, a coil assembly 120, a coil spring 116, an armature 124, a closure member 126, a non-magnetic shell 110*a*, a first overmold 118, a valve body 132, a valve body shell 132*a*, a second overmold 119, a coil assembly housing 121, a guide member 127 for the closure member 126, a seat 134, and a metering disc 10.

The guide member 127, the seat 134, and the metering disc 10 form a stack that is coupled at the outlet end of fuel injector 100 by a suitable coupling technique, such as, for example, crimping, welding, bonding or riveting. Armature 124 and the closure member 126 are joined together to form an armature/needle valve assembly. It should be noted that one skilled in the art could form the assembly from a single component. Coil assembly 120 includes a plastic bobbin on which an electromagnetic coil 122 is wound.

Respective terminations of coil 122 connect to respective terminals 122*a*, 122*b* that are shaped and, in cooperation with a surround 118*a* formed as an integral part of overmold 118, to form an electrical connector for connecting the fuel injector to an electronic control circuit (not shown) that operates the fuel injector.

Fuel inlet tube 110 can be ferromagnetic and includes a fuel inlet opening at the exposed upper end. Filter assembly 114 can be fitted proximate to the open upper end of adjustment tube 112 to filter any particulate material larger than a certain size from fuel entering through inlet opening before the fuel enters adjustment tube 112.

In the calibrated fuel injector, adjustment tube 112 has been positioned axially to an axial location within fuel inlet tube 110 that compresses preload spring 116 to a desired bias force that urges the armature/needle valve such that the rounded tip end of closure member 126 can be seated on seat 134 to close the central hole through the seat. Preferably, tubes 110 and 112 are crimped together to maintain their relative axial positioning after adjustment calibration has been performed.

After passing through adjustment tube 112, fuel enters a volume that is cooperatively defined by confronting ends of inlet tube 110 and armature 124 and that contains preload spring 116. Armature 124 includes a passageway 128 that communicates volume 125 with a passageway 113 in valve body 130, and guide member 127 contains fuel passage holes 127*a*, 127*b*. This allows fuel to flow from volume 125 through passageways 113, 128 to seat 134.

Non-ferromagnetic shell 110*a* can be telescopically fitted on and joined to the lower end of inlet tube 110, as by a hermetic laser weld. Shell 110*a* has a tubular neck that telescopes over a tubular neck at the lower end of fuel inlet tube 110. Shell 110*a* also has a shoulder that extends radially outwardly from neck. Valve body shell 132*a* can be ferromagnetic and can be joined in fluid-tight manner to non-ferromagnetic shell 110*a*, preferably also by a hermetic laser weld.

The upper end of valve body 130 fits closely inside the lower end of valve body shell 132*a* and these two parts are joined together in fluid-tight manner, preferably by laser welding. Armature 124 can be guided by the inside wall of valve body 130 for axial reciprocation. Further axial guidance of the armature/needle valve assembly can be provided by a central guide hole in member 127 through which closure member 126 passes.

Referring to a close up illustration of the seat subassembly of the fuel injector in FIG. 2, which has a closure member 126, seat 134, and a metering disc 10. The closure member 126 includes a spherical surface shaped member 126*a* disposed at one end distal to the armature. The spherical member 126*a* engages the seat 134 on seat surface 134*a* so as to form a generally line contact seal between the two members. The seat surface 134*a* tapers radially downward and inward toward the seat orifice 135 such that the surface 134*a* is oblique to the longitudinal axis A—A. The words "inward" and "outward" refer to directions toward and away from, respectively, the longitudinal axis A—A. The seal can be defined as a sealing circle 140 formed by contiguous engagement of the spherical member 126*a* with the seat surface 134*a*, shown here in FIG. 2. The seat 134 includes a seat orifice 135, which extends generally along the longitudinal axis A—A of the fuel injector 100 and is formed by a generally cylindrical wall 134*b*. Preferably, a center 135*a* of the seat orifice 135 is located generally on the longitudinal axis A—A.

Downstream of the circular wall 134*b*, the seat 134 extends in an orthogonal manner relative to the longitudinal axis A—A to form channel surface 134*d*. Although not required, a chamfer 134*c* is preferably provided so as to reduce or eliminate burrs that might be formed during manufacturing of the seat 134.

Although not shown here, the metering disc 10 is preferably planar over its entire surface prior to being deformed so as to form a constant velocity flow channel 146 (FIG. 3). The interior face 144 of the metering disc 10 proximate to the outer perimeter of the metering disc 10 engages the bottom surface 134*e* along a generally annular contact area. The seat orifice 135 is preferably located wholly within the perimeter, i.e., a "bolt circle" 150 defined by an imaginary line connecting a center of each of the metering orifices 142. That is, a virtual extension of the surface of the seat 135 generates a virtual orifice circle 152 that is preferably disposed within the bolt circle 150.

The generally constant velocity flow channel 146 is formed between the seat orifice 135 of the seat 134 and interior face 134*e* of the metering disc 10, illustrated here in FIGS. 2 and 3. Specifically, the channel 146 is initially formed by dimpling a surface area surrounding the bolt circle 150 in a direction downstream along the longitudinal axis A—A. This dimpling transforms a generally planar surface into a generally conic surface area 145. As used herein, the term "dimpling" denotes that a generally material can be deformed by stamping or deep drawing a planar surface. That is to say, a generally planar surface on which at least one metering orifice 142 is disposed thereon can be oriented along a plane $C_1$ and at least another metering orifice 142 can be disposed on a surface oriented along a plane $C_2$ oblique to a referential datum plane B—B. In a preferred embodiment, the planes $C_1$ and $C_2$ are generally symmetrical about the longitudinal axis A—A.

Due to the transformation of the initial planar surface on which the metering orifices 142 are located on into the generally conic surface area 145, each metering orifice 142 (as indicated by its metering orifice axis 170 in a pre-dimpled orientation) is re-orientated (FIG. 3) such that each metering orifice 142 is no longer generally parallel to the longitudinal axis A—A (as indicated by its metering orifice axis 172 in a post-dimpled orientation). As a result, each metering orifice 142 is now orientated oblique to the longitudinal axis A—A at an orientation angle $\lambda$.

The channel 146 changes in cross-sectional area as the channel 146 extends outwardly from the seat orifice 135 of the seat 134 along the longitudinal axis A—A to the plurality of metering orifices 142 of the metering disc 10 such that fuel flow along the longitudinal axis through the seat orifice 135 is imparted with a radial velocity between the orifice and the plurality of metering orifices.

However, dimpling of the interior surface 134*e* (i.e., the fuel inlet side) of the metering disc 10 tends to increase a "sac volume" between the closure member 126*a* and the metering disc 10. "Sac volume" is the small volume of fuel remaining in the interior of the tip of the injector that is believed to affect combustion and emission at the end of a fuel injection cycle. In order to reduce the "sac volume," the surface 134*f* (i.e. the fuel outlet side) can be dimpled towards the upstream direction with a suitable tool that preferably forms a sac volume reducer 160. The sac volume reducer 160 projects toward the seat orifice 135 with a radius of curvature to reduce the interior volume between the closure member 126*a* and the metering disc 10, which reduced interior volume tends to reduce the sac volume. Preferably, the sac volume reducer 160 is in the shape of a curved dome having a predefined radius of curvature. The sac volume reducer 160 is preferably formed such that the reducer 160 forms a perimeter 154 surrounding the virtual circle 152 on the surface 145 of the metering disc 10.

The deformation of the surface 134*e* and surface 134*f* can be performed simultaneously or one surface can be deformed during a time interval that overlaps a time interval of the deformation of the other surface. Alternatively, the surface 134*e* can be deformed before the second surface 134*f* is deformed. In a preferred embodiment, the surface 134*e* is deformed before the second surface 134*f* is deformed.

A physical representation of a particular relationship has been discovered that allows the controlled velocity channel 146 to provide a generally constant velocity to fluid flowing through the channel 146. In a preferred physical embodiment of this relationship, the channel 146 tapers outwardly from height $h_1$ at the seat orifice 135, as measured preferably from a position contiguous to a metering orifice 142 to referential datum plane B—B with corresponding diametrical distance $D_1$ to a height $h_2$ to referential datum plane B—B of a point on a perimeter of an area surrounding the seat orifice virtual circle 152 with corresponding diametrical distance $D_2$. Preferably, a product of the height $h_1$, distance $D_1$ and $\pi$ is approximately equal to the product of the height $h_2$, distance $D_2$ and $\pi$ (i.e. $D_1*h_1*\pi=D_2*h_2*\pi$ or $D_1*h_1=D_2*h_2$) formed by the seat 134 and the metering disc 10.

The channel surface 145 can be linear or curvilinear such that it forms a taper having an angle $\beta$ between $h_1$ and $h_2$. The distance $h_2$ is believed to be related to the taper in that the greater the height $h_2$, the greater the taper angle $\beta$ is required and the smaller the height $h_2$, the smaller the taper angle $\beta$ is required. An annular volume 148 that is preferably frustoconical in shape is formed between the wall surface 145 and the referential datum plane B—B.

By providing a generally constant velocity of fuel flowing through the controlled velocity channel 146, it is believed that a sensitivity of the position of the metering orifices 142 relative to the seat orifice 135 in spray targeting and spray distribution is minimized. That is to say, due to manufacturing tolerances, an acceptable level concentricity of the array of metering orifices 142 relative to the seat orifice 135 may be difficult to achieve. As such, features of the preferred embodiment are believed to provide a metering disc for a fuel injector that is believed to be less sensitive to concentricity variations between the array of metering orifices 142 on the bolt circle 150 and the seat orifice 135. It is also noted that those skilled in the art will recognize that from the particular relationship, the velocity can decrease, increase or both increase/decrease at any point throughout the length of the channel 146, depending on the configuration of the channel, including varying $D_1$, $h_1$, $D_2$, or $h_2$ of the controlled velocity channel 146, such that the product of $D_1$ and $h_1$ can be less than or greater than the product of $D_2$ and $h_2$.

By imparting a different radial velocity to fuel flowing through the seat orifice 135, it has been discovered that the outward flow angle of fuel spray exiting the metering orifices 142 can be changed as a generally linear function of the radial velocity—i.e., the "linear separation angle effect." The radial velocity can be changed preferably by changing the configuration of the seat subassembly, the metering disc (including $D_1$, $h_1$, $D_2$, or $h_2$ of the controlled velocity channel 146), changing the flow rate of the fuel injector, or by a combination thereof.

Furthermore, it has also been discovered that spray separation targeting can also be adjusted by varying a ratio of the through-length (or orifice length) "t" of each metering orifice to the diameter "D" of each orifice. In particular, the outward flow angle $\theta$ is linearly and inversely related to the aspect ratio t/D. The outward flow angle $\theta$ and cone size of the fuel spray are related to the aspect ratio t/D. As the aspect ratio increases or decreases, the outward flow angle $\theta$ and cone size increase or decrease, at different rates, correspondingly. Where the distance D is held constant, the larger the thickness "t", the smaller the outward flow angle $\theta$ and cone size. Conversely, where the thickness "t" is smaller, the outward flow angle $\theta$ and cone size are larger. Hence, where a small cone size is desired but with a large outward flow angle, it is believed that spray separation can be accomplished by configuring the velocity channel 146 and space 148 while cone size and to a lesser extent, the outward flow angle $\theta$, can be accomplished by configuring the t/D ratio of the metering disc 10. It should be reiterated that the ratio t/D not only affects the outward flow angle, it also affects a size of the spray cone emanating from the metering orifice in a generally linear and inverse manner to the ratio t/D—i.e., the "linear and inverse separation effect." Although the through-length "t" (i.e., the length of the metering orifice along the longitudinal axis A—A) is shown in FIG. 3 as being substantially the same as that of the thickness of the metering disc 10, it is noted that the thickness of the metering disc can be different from the through-length t of each of the metering orifices 142. As used herein, the term "cone size" denotes the circumference or area of the base of a fuel spray pattern defining a conic fuel spray pattern as measured at predetermined distance from the metering disc of the fuel injector 100.

An actual separation angle $\phi$ can be, generally, the sum of the orientation angle $\lambda$ and the outward flow angle $\theta$ formed by either manipulation of the channel 146 or the aspect ratio t/D of the metering disc 10. Preferably, the orientation angle $\lambda$ is approximately 10 degrees. And as used herein, the term "approximately" encompasses the stated value plus or minus 25 percent (±25%).

The metering disc 10 has a plurality of metering orifices 142, each metering orifice 142 having a center located on an imaginary "bolt circle" 150 prior to a deformation or dimpling of the metering disc 10. Although the metering orifices 142 are preferably circular openings, other orifice configurations, such as, for examples, square, rectangular, arcuate or slots can also be used. The metering orifices 142 are arrayed in a preferably circular configuration, which configuration, in one preferred embodiment, can be generally concentric with a seat orifice virtual circle 152. The seat orifice virtual circle 152 is formed by a virtual projection of the orifice 135 onto the metering disc 10 such that the seat orifice virtual circle 152 is within the bolt circle 150. Further, a virtual projection of the sealing surface 134*a* onto the metering disc 10 forms an apex "P" on the interior surface 134*e* of the metering disc 10 that is within the seat orifice virtual circle 152. And the preferred configuration of the seat 134, metering disc 10, metering orifices 142 and the channel 146 therebetween allows a flow path of fuel extending radially from the orifice 135 of the seat 134 in any one radial direction away from the longitudinal axis towards the metering disc passes to one metering orifice 142.

Thus, it has been discovered that manipulation of at least one of either the taper of the flow channel 146 or the ratio t/D allows a metering orifice 142 to provide for an actual separation angle $\phi$ that is greater than an orientation angle $\lambda$ of the metering orifice 142.

The techniques previously described can be used to tailor the spray geometry (narrower spray pattern with greater spray angle to wider spray pattern but at a smaller spray angle) of a fuel injector to a specific engine design while using non-angled metering orifices (i.e. orifices having an axis generally parallel to the longitudinal axis A—A). Furthermore, the actual separation angle $\phi$ of fuel spray can be adjusted by dimpling the surface of the metering disc in two different directions along the longitudinal axis that provides for a desired separation angle and reducing the sac volume. And the dimpling of the interior surface 134*e* to form the desired angle $\lambda$ can be done at a first time interval while the dimpling of the exterior surface 134*f* can be done to form the sac volume reducer 160 can be done at a second time interval that may overlap or discrete from the first time interval.

In operation, the fuel injector 100 is initially at the non-injecting position shown in FIG. 1. In this position, a working gap exists between the annular end face 110*b* of fuel inlet tube 110 and the confronting annular end face 124*a* of armature 124. Coil housing 121 and tube 12 are in contact at 74 and constitute a stator structure that is associated with coil assembly 18. Non-ferromagnetic shell 110*a* assures that when electromagnetic coil 122 is energized, the magnetic flux will follow a path that includes armature 124. Starting at the lower axial end of housing 34, where it is joined with valve body shell 132*a* by a hermetic laser weld, the magnetic circuit extends through valve body shell 132*a*, valve body 130 and eyelet to armature 124, and from armature 124 across working gap 72 to inlet tube 110, and back to housing 121.

When electromagnetic coil 122 is energized, the spring force on armature 124 can be overcome and the armature is attracted toward inlet tube 110 reducing working gap 72. This unseats closure member 126 from seat 134 open the fuel injector so that pressurized fuel in the valve body 132 flows through the seat orifice and through orifices formed on the metering disc 10, 10*a*, 10*b* or 10*c*. It should be noted here that the actuator may be mounted such that a portion of the actuator can disposed in the fuel injector and a portion can be disposed outside the fuel injector. When the coil ceases to be energized, preload spring 116 pushes the armature/needle valve closed on seat 134.

As described, the preferred embodiments, including the techniques or method of targeting, are not limited to the fuel injector described but can be used in conjunction with other fuel injectors such as, for example, the fuel injector sets forth in U.S. Pat. No. 5,494,225 issued on Feb. 27, 1996, or the modular fuel injectors set forth in Published U.S. patent application No. 2002/0047054 A1, published on Apr. 25, 2002, which is pending, and wherein both of these documents are hereby incorporated by reference in their entireties.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A. fuel injector comprising:

a housing having an inlet, an outlet, and a longitudinal axis extending therethrough;

a seat disposed proximate the outlet, the seat having a sealing surface surrounding a seat orifice, the seat orifice being disposed along the longitudinal axis between the sealing surface and a first channel surface extending generally orthogonal about the longitudinal axis;

a closure member reciprocally located within the housing along the longitudinal axis between a first position displaced from the sealing surface to permit fuel flow through the seat orifice and a second position of the closure member contiguous to the sealing surface to occlude fuel flow;

a metering disc having a plurality of metering orifices extending through the metering disc along the longitudinal axis, the metering orifices being located about the longitudinal axis on a first virtual circle greater than a second virtual circle defined by a projection of the sealing surface converging at a virtual apex disposed on the metering disc, the metering disc including a second channel surface confronting the first channel surface, the second channel surface having at least a first surface portion generally oblique to the longitudinal axis and at least a second surface portion forming curved surface with respect to the longitudinal axis; and a controlled velocity channel formed between the first and second channel surfaces, the controlled velocity channel having a first portion changing in cross-sectional area as the channel extends outwardly along the longitudinal axis to a location cincturing the plurality of metering orifices such that a fuel flow path exiting through each of the plurality of metering orifices forms a flow path oblique to the longitudinal axis.

2. The fuel injector of claim 1, wherein the controlled velocity channel extends between a first end and a second end, the first end disposed at a first radius from the longitudinal axis with the first and second channel surfaces spaced apart along the longitudinal axis at a first distance, the second end disposed at a second radius proximate the plurality of metering orifices with respect to the longitudinal axis with the first and second channel surfaces spaced apart along the longitudinal axis at a second distance such that a product of two times the trigonometric constant pi ($\pi$) times the first radius and the first distance is equal to a product of two times the trigonometric constant pi ($\pi$) of the second radius and the second distance.

3. The fuel injector of claim 2, wherein the plurality of metering orifices includes at least two metering orifices diametrically disposed on the first virtual circle.

4. The fuel injector of claim 1, wherein the plurality of metering orifices includes at least two metering orifices, each metering orifice having a through-length and an orifice diameter and being configured such that an increase in a ratio of the through-length relative to the orifice diameter results in a decrease in the spray angle relative to the longitudinal axis.

5. The fuel injector of claim 1, wherein the plurality of metering orifices includes at least two metering orifices, each metering orifice having a through-length and an orifice diameter and being configured such that an increase in a ratio of the through-length relative to the orifice diameter results in a decrease in an included angle of a spray cone produced by each metering orifice.

6. The fuel injector of claim 5, wherein second channel surface comprises a first generally planar surface portion cincturing second and third surface portions, the second and third surface portions projecting from the plane contiguous to the first generally planar surface portion.

7. The fuel injector of claim 6, wherein the second surface portion comprises at least one planar surface.

8. The fuel injector of claim 7, wherein the third surface portion intersects the longitudinal axis.

9. The fuel injector of claim 8, wherein the third surface portion projects towards the seat orifice to reduce a volume formed between the closure member and the metering disc when the closure member is contiguous to the sealing surface of the seat.

10. The fuel injector of claim 9, wherein the third surface portion intersects the second surface portion to define a generally circular perimeter defining an area equal to the area of the seat orifice orthogonally with respect to the longitudinal axis.

11. The fuel injector of claim 10, wherein the area of the generally circular perimeter is less than the area of the seat orifice.

12. The fuel injector of claim 8, wherein the plurality of metering orifices is disposed on the at least one planar surface of the second surface portion.

13. The fuel injector of claim 9, wherein the first channel surface includes at least a portion extending at a taper angle with respect to the longitudinal axis.

14. The fuel injector of claim 10, wherein the taper angle comprises a taper angle of approximately ten degrees with respect to a plane transverse to the longitudinal axis.

15. The fuel injector of claim 11, wherein the first channel surface comprises a portion curved with respect to the at least a portion of the first channel surface.

16. A method of controlling a spray angle of fuel flow through at least one metering orifice of a fuel injector having an inlet, outlet, and passage extending along a longitudinal axis therethrough, the outlet having a seat and a metering disc, the seat having a seat orifice and a first channel surface , the metering disc having a second channel surface confronting the first channel surface so as to provide a flow channel, the metering disc having a plurality of metering orifices extending through the metering disc along the longitudinal axis, the method comprising:

inducing the fuel flow to flow radially outward along the longitudinal axis between the first and second channel surfaces, the first channel surface extending generally orthogonal to the longitudinal axis;

deforming a portion of the second channel surface, at a dimpling angle relative to the longitudinal axis, on which the plurality of metering orifices are located so that a flow path of the fuel flow through each of the metering orifices is oblique with respect to the longitudinal axis as a function of the radial velocity and the dimpling angle; and reducing a sac volume formed between the first channel surface and the second channel surface with a curved portion of the second channel surface intersecting the longitudinal axis.

17. The method of claim 16, wherein deforming further comprises adjusting the flow path of fuel away from the outlet at a greater included angle with respect to the longitudinal axis by reducing the orifice length of each metering orifice with the dimpling angle, radial velocity, and orifice diameter unchanged.

18. The method of claim 16, wherein deforming further comprises adjusting the flow path of fuel away from the outlet at a smaller included angle with respect to the longitudinal axis by increasing the orifice length of each metering orifice with the dimpling angle, radial velocity, and orifice diameter unchanged.

19. The method of claim 16, wherein the deforming further comprises adjusting the dimpling angle with the radial velocity, orifice length, orifice diameter unchanged such that an increased dimpling angle results in a greater included angle between the flow path of fuel from the outlet with respect to the longitudinal axis.

20. The method of claim 19, wherein the reducing comprises deforming the metering disc from opposite directions along the longitudinal axis.

* * * * *